United States Patent [19]

Butler

[11] Patent Number: 4,630,406

[45] Date of Patent: Dec. 23, 1986

[54] METHOD OF USING AN ELLIPTICAL FORM TO GENERATE A PERFECT RADIUS IN AN INSULATED ELECTRICAL CONDUCTOR STRIPPING BLADE

[75] Inventor: John D. Butler, New Berlin, Wis.

[73] Assignee: Mechtrix Corporation, Wauwatosa, Wis.

[21] Appl. No.: 652,198

[22] Filed: Sep. 20, 1984

[51] Int. Cl.[4] ..... B24B 3/36

[52] U.S. Cl. ..... 51/285; 51/5 D; 51/34 R; 51/92 BS; 76/101 R

[58] Field of Search ..... 51/5 D, 34 R, 37, 92 BS, 51/218 R, 224, 281 R, 285; 30/90.1; 76/101 R; 81/9.4, 9.41, 9.42, 9.43, 9.44, 9.51

[56] References Cited

U.S. PATENT DOCUMENTS

| | | | |
|---|---|---|---|
| Re. 26,687 | 10/1969 | Kelly | 81/9.41 X |
| 1,305,513 | 6/1919 | Bernard | 81/9.44 |
| 2,133,005 | 10/1938 | Wollenweber | 30/90.1 X |
| 2,291,255 | 7/1942 | Powell | 51/218 R |
| 2,510,301 | 6/1950 | Wiegand | 51/218 R X |
| 4,274,231 | 6/1981 | Verega | 51/5 D X |

*Primary Examiner*—Robert P. Olszewski

*Attorney, Agent, or Firm*—Fuller, House & Hohenfeldt

[57] ABSTRACT

An improved blade for cutting and stripping insulation from insulated electrical conductors has a cutting edge with a circular cross-section when viewed in the direction parallel to the axis of the insulated conductor to be stripped instead of the elliptical cutting edge of conventional blades. The blade is manufactured by feeding a manufacturing tool through a blank so as to generate a curved surface having a longitudinal axis connecting the blank faces at an angle thereto. The curved surface has an elliptical contour when viewed along the axis.

3 Claims, 14 Drawing Figures

METHOD OF USING AN ELLIPTICAL FORM TO GENERATE A PERFECT RADIUS IN AN INSULATED ELECTRICAL CONDUCTOR STRIPPING BLADE

BACKGROUND OF THE INVENTION

1. Field of the Invention

This invention pertains to wire stripping apparatus with V type cutting blades.

2. Description of the Prior Art

Industry utilizes two basic types of cutting blades for high production stripping of insulation from insulated electrical conductors, the die type and the V type. FIG. 1*a* illustrates a pair of typical die type blades 2 and 4. In the die type design, the knife blades 2 and 4 form two halves of a counterbored hole 6 and a smaller through hole 8. See FIG. 1*b*. The two blades are closed over the insulation of a specifically sized insulated conductor at the desired location thereon. The die type design possesses the advantages of closely conforming to the configuration of the conductor around the full periphery thereof and of having a depth of cut controlled by the contacting of leading edges 12 to prevent nicking and scoring the conductor. Nicks are undesirable because they decrease electrical current carrying capacity, and they produce stress concentrations which decrease the tensile strength of the conductor. However, die type blades suffer from four disadvantages. The first is that a pair of die blades is designed to be used with only one size of insulated conductor. Secondly, some insulation is usually squeezed between the conductor and the periphery of hole 8, which may prevent the blades from fully cutting through the insulation. As a result, the uncut insulation must be torn from the parent insulation. The physical characteristics of some insulation materials make them difficult to tear, so it is desireable that the blades cut completely through the insulation. The third disadvantage is that die type blades have only limited ability to gather off-center insulated conductors to the cutting edges of the blades. In many applications, special wire guides in the form of mechanical fingers are required to ensure that the insulated conductor is on the center line of the closed blades. The fourth disadvantage is that die type blades are difficult and expensive to manufacture. Referring to FIG. 1*a* it is apparent that the intricate shapes of the blades 2 and 4 are costly to produce.

FIGS. 1*c* and 1*d* show a conventional V type blade 1 which is in widespread commercial use. The blade includes a V-shaped opening 3 which terminates in a generally round cutting edge 5. Blades are used in pairs to close over an insulated conductor (not shown) for gathering and directing it to the cooperating cutting edges. Ideally, the blade cutting edges slice the insulation from the insulated conductor while avoiding contact with the conductor.

It is desirable that the cutting edge 5 be circular in the plane coinciding with blade face 10. That is because insulated conductors are fed to the blades in a direction perpendicular to the face 10, and the periphery of a conductor is a circle. Any cutting edge contour other than a circle does not conform to the conductor circumference and thus does not optimally cut the insulation. If the non-circular cutting edge closes over the conductor so as to avoid contact with the conductor, some insulation remains uncut. The uncut insulation must be torn away during the stripping process. If the non-circular cutting edge is closed over the conductor so that substantially all the insulation is cut, a portion of the cutting edge will contact and nick the conductor.

A common method of manufacturing conventional V type blades is illustrated in FIGS. 2*a* and 2*b*. Several blade blanks 7 are secured in a blade fixture 9 such that faces 10 of the blanks make an angle A with the fixture. A blade manufacturing tool, such as an abrasive wheel 11, is fed through the blanks 7 in the direction of arrow 13. The periphery of the abrasive wheel 11 is dressed to a circular cross-section, as indicated by reference letter R. The resulting blade is as shown in FIGS. 1*c* and 1*d*. It will be understood that the aforedescribed method may be used to manufacture compound angled stripping blades as disclosed in my co-pending U.S. patent application Serial No. 651,830.

The basic shortcoming of conventional blades 1 is that the cutting edge 5 is not circular in the plane coinciding with face 10. Rather, the cutting edge is elliptical in that plane. That may be demonstrated with the aid of FIG. 3. In FIG. 3, the plane a—a represents a blade blank 7 held in a fixture so that the faces 10 are at an angle A to the direction of motion 17 of wheel 11. The semi-circle 15 represents the transverse contour of the wheel periphery and also the transverse contour of the path formed in the blank as the wheel passes through the blank. The travel of the semi-circular periphery of the grinding wheel in the direction of arrow 17 produces half of a right circular cylinder 19 having longitudinal axis 20. The intersection of the half cylinder 19 with the plane a—a results in half of an ellipse 21. Thus, conventional grinding techniques produce cutting and stripping blades having elliptical cutting edges corresponding with ellipse 21 in the plane of face 10 rather than circular cutting edges.

It will be understood that other manufacturing methods are also in more or less widespread use. Fabricating stripping blades by means of wheel dressing blocks, crush rolls, electrodischarge machining, and pantograph and/or optical grinding are well known in the art. In the various manufacturing techniques the manufacturing tool is fed into the blank or the blank is fed into the tool so as to remove material in the form of a partial circular cylinder having a longitudinal axis which is at an angle to the blade face 10. Standard techniques more easily make simple geometric forms such as circles. Consequently, a circular grinding wheel cross-section is used which produces an elliptical cutting edge with respect to the axis of the insulated conductor to be cut and stripped. For certain conductor diameters and angles, the blade cutting edge 5 is only slightly elliptical. For that reason, elliptical cutting edges have been satisfactory for some applications. Nevertheless, a need exists for an insulation cutting and stripping blade having a cutting edge which is circular with respect to the contour of the conductor and for a tool and method for making the cutting blade.

SUMMARY OF THE INVENTION

In accordance with the present invention, a V type insulation cutting and stripping blade is provided having a cutting edge which conforms more closely to the contour of the conductor being stripped than prior art V type blades. This is accomplished by apparatus which includes a circular cutting edge in the plane transverse to the insulated conductor axis.

The cutting and stripping blade with the circular cutting edge is manufactured by removing predetermined amounts of material from a blank shaped generally as a rectangular parallelopiped. To remove the proper amount of material, a manufacturing tool is fed into the blank so as to generate a curved surface in the blank which is symmetrical about a longitudinal axis extending at an angle between the blank faces. Thus, a curved surface is generated which connects the two faces. The junction of the curved surface and one face forms sharp edges which preferably define a generally V-shaped opening in the blade. The opening terminates in a curved sharp insulation cutting edge, to which the V-shaped edges are tangent.

In the preferred embodiment, the manufacturing tool removes material from the blank so as to generate a surface which is elliptical about the longitudinal axis angled to the blank face. The intersection of the elliptical surface produced by the tool with the blank faces results in a circular cutting edge in the blade face when viewed perpendicular to the blade face. Since insulated conductors are fed to the stripping blade in a direction perpendicular to the blade faces, a circular cutting edge is available to cut and strip the insulation from the conductor.

The cutting and stripping blade of the present invention may be manufactured by any of several methods, including grinding, electrodischarge machining, and pantograph and/or optical grinding. When the grinding method is used, the periphery of the grinding wheel is dressed to an elliptical cross-section. To suit the desired blade cutting edge size and angle of the curved cutting surfaces, the coordinates of the points on the wheel periphery must be mathematically determined. With electrodischarge machining, a copper electrode is fed into the cutting blade blank along a predetermined elliptical path symmetrical about a longitudinal axis which is angled to the blank faces.

Other objects and advantages of the invention will become apparent from the disclosure.

BRIEF DESCRIPTION OF THE DRAWINGS

FIG. 8*b* is an enlarged view of the elliptical periphery of the grinding wheel of FIG. 8*a.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 4:
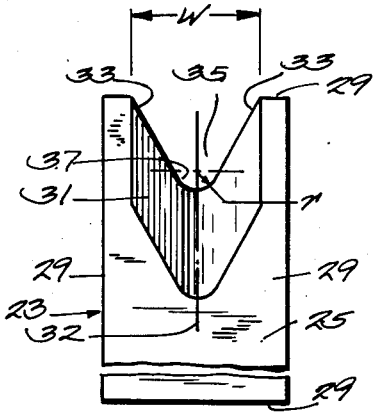
FIG. 4 is a front view of a cutting and stripping blade according to the present invention.
Figure 5:
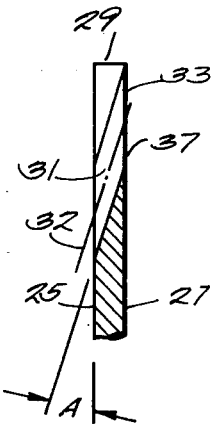
FIG. 5 is a cross-sectional view of the stripping blade of FIG. 4.

Referring to FIGS. 4 and 5, a V type cutting and stripping blade 23 is illustrated which includes the present invention. The blade 23 is especially useful when used in pairs to cut and strip insulation from insulated electrical conductors. However, it will be understood that the invention is not limited to electrical applications.

The blade 23 is generally shaped as a parallelopiped having faces 25 and 27 connected by exterior surfaces 29. The faces 25 and 27 are also connected by a curved surface 31 having a longitudinal axis 32 which extends at an angle A between the faces. Surface 31 and face 27 join at edges 33. The edges 33 define a generally V-shaped opening 35 in one of the exterior surfaces 29. To efficiently cut the insulation 30 from an insulated conductor 39 (FIG. 6), the opening 35 terminates in a sharp cutting edge 37. The edges 33 are tangent to the cutting edge 37.

Figure 6:
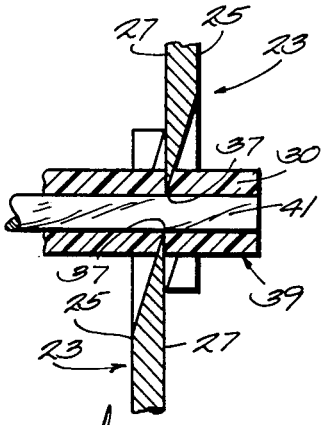
FIG. 6 is an enlarged cross-sectional view of a pair of V type blades cutting the insulation of an insulated conductor.

In accordance with the present invention, the cutting edge 37 is circular in shape when viewed in a direction perpendicular to the faces 25 and 27. As shown in FIG. 6, an insulated conductor 39 to be stripped is fed perpendicular to the faces 25 and 27. Thus, the circular contour of the cutting edge 37 may exactly match the circumference of the conductor 41.

Figure 3:
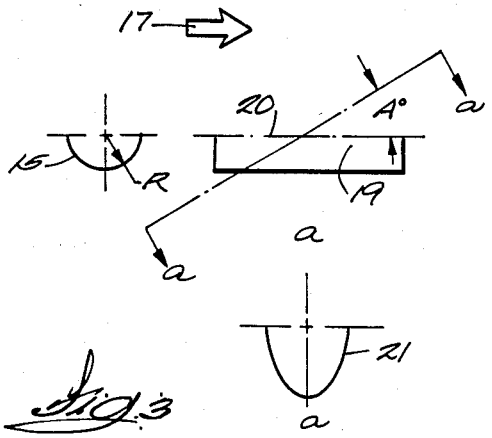
Fig. 3 PRIOR ART
FIG. 3 is a geometrical representation of conventional manufacture of V type stripping blades.
Figure 7:
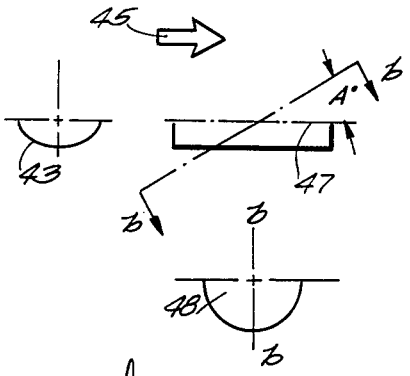
FIG. 7 is a geometrical representation of the manufacture of a cutting and stripping blade according to the present invention.
Figure 1B:
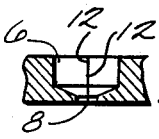
Fig. 1b PRIOR ART
FIG. 1*b* is a sectional view through the cutting edges of die type blades with the blades being shown in the closed position for cutting the insulation of an insulated conductor.
Figure 1A:
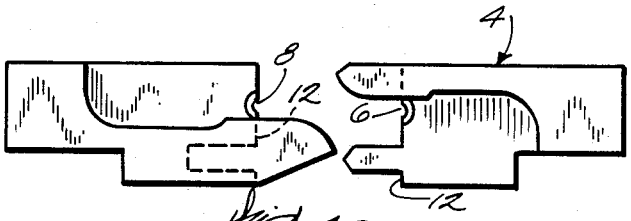
Fig. 1a PRIOR ART
FIG. 1*a* is a front view of a pair of conventional die type blades for cutting and stripping insulation from insulated electrical conductors.
Figure 2A:
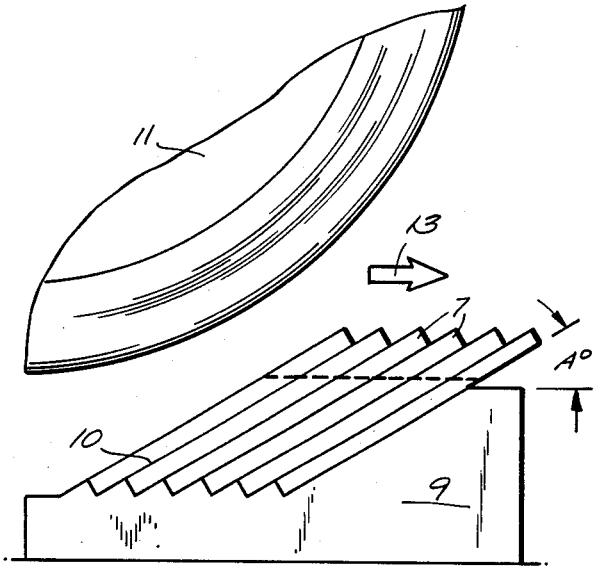
Fig. 2a PRIOR ART
FIG. 2*a* is a schematic side view of typical conventional apparatus for manufacturing conventional V type stripping blades.
Figure 1C:
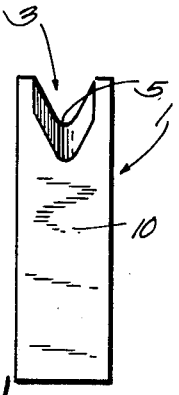
Fig. 1c PRIOR ART
FIG. 1*c* is a front view of a conventional V type blade for cutting and stripping insulation from insulated electrical conductors.
Figure 1D:
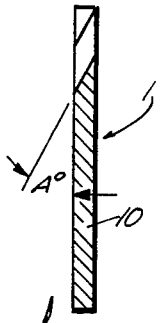
Fig. 1d PRIOR ART
FIG. 1*d* is a cross-sectional view of the cutting and stripping blade of FIG. 1*c;*
Figure 2B:
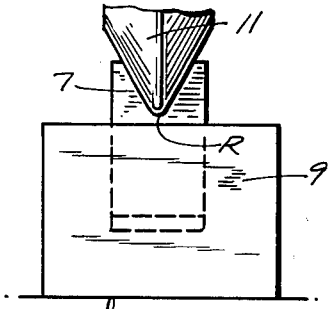
Fig. 2b PRIOR ART
FIG. 2*b* is an end view of the apparatus of FIG. 2*a;*

On the other hand, when viewed in a direction along axis 32 of curved surface 31, the cutting edge 37 and surface 31 of the present invention are elliptical in shape. That is because, in the preferred embodiment, the blade 23 is manufactured by a tool which generates an elliptical path about the axis 32 as the tool is fed through the blade blank. For example, the blade may be manufactured by a grinding wheel 11, in a manner similar to the conventional apparatus and method of FIGS. 2*a* and 2*b*. Pursuant to the invention, however, the periphery of the grinding wheel is not dressed to a circular cross-section having the radius R as in FIG. 2*b*. Rather, the periphery is dressed to an elliptical contour 43, FIG. 7. Consequently, as the wheel dressed with ellipse 43 translates in the direction of arrow 45, it creates half of a right cylinder 47 with an elliptical cross-section corresponding to ellipse 43 and having a longitudinal axis 32. In FIG. 7, the intersection of a plane b—b with the half-elliptical cylinder 47 is a semi-circle 48 if the proper relationship is maintained between the coordinates of the wheel periphery and angle A. The required relationship is given by the formula:

$$\frac{x^2}{r^2} + \frac{y^2}{(r \sin A)^2} = 1$$

where x is the coordinate from the ellipse centerline in the direction parallel to the wheel axis of rotation, y is the coordinate from the ellipse centerline in the direction perpendicular to the wheel axis of rotation, r is the desired cutting edge radius, and A is the angle of the blade blank relative to the direction of travel of the wheel.

Figure 8A:
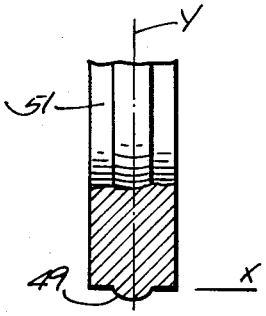
FIG. 8*a* is a partial cross-sectional view of a grinding wheel dressed with an elliptical periphery for manufacturing cutting and stripping blades according to the present invention.
Figure 8B:
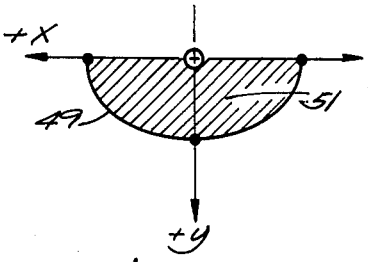

FIG. 8*a* and 8*b* show a cross-section of the periphery 49 of a grinding wheel 51 according to the present invention. Table 1 shows a typical set of coordinates as applied to the periphery 49 for obtaining a circular cutting edge 37 in FIG. 4.

| X | Y |
|---|---|
| 0 | .008208 |
| 0.002 | .008180 |
| 0.004 | .008094 |
| 0.006 | .007948 |
| 0.008 | .007739 |
| 0.010 | .007462 |
| 0.012 | .007109 |
| 0.014 | .006667 |
| 0.016 | .006118 |
| 0.018 | .005429 |
| 0.020 | .004537 |
| 0.021 | .003974 |
| 0.022 | .003281 |
| 0.023 | .002345 |
| 0.024 | 0 |

It will be understood that the coordinates calculated by the foregoing formula are not limited to manufacturing methods involving grinding wheels. On the contrary, the formula is of universal application for determining the coordinates of an elliptical path 43 (FIG. 7) generated by any manufacturing tool as it is fed into a blank at angle A. Thus, with an electrodischarge machine, the coordinates given by the formula represent the path of the electrode as it generates an elliptical surface having a longitudinal axis 32 at angle A to faces 25 and 27, FIG. 5. The curved surface 31 thus generated creates a circular cutting edge 37 when viewed perpendicular to the faces 25 and 27.

Figure 9:
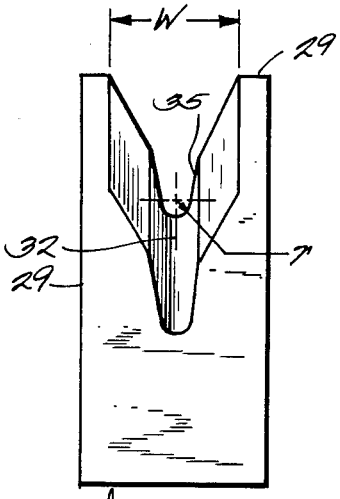
Fig. 9 PRIOR ART
* and FIG. 9 is a front view of a compound angle V type stripping blade according to the present invention.

The present invention is not limited to V type blades having a single V. Rather, the invention is equally applicable to compound angled V type blades, such as is illustrated in FIG. 9, and to blades with true radius shaped openings, semi-circular, and partially circular shaped openings. In both the single angle blade of FIG. 4 and the compound angle blade of FIG. 9, the width W of the V shaped openings 35 may be identical with the respective openings in prior art blades.

Thus, it is apparent that there has been provided, in accordance with the invention, a stripping blade having a circular radius for cutting and stripping insulation from insulated electrical conductors and apparatus for manufacturing the stripping blade which fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A method of manufacturing a blade for cutting and stripping insulation from an insulated electrical conductor, the blade having two faces and a predetermined curved surface connecting the two faces, the curved surface having a longitudinal axis at a predetermined angle to the faces and an elliptical contour symmetrical about the axis when viewed along the axis, the cutting edge in the blank at the junction of the curved surface and one of the faces being circular when viewed perpendicular to the blade faces, comprising the steps of:

a. providing a blank generally shaped as a rectangular paralleopiped having two faces and exterior surfaces;

b. providing a grinding wheel;

c. dressing the periphery of the grinding wheel to a predetermined elliptical cross-section corresponding to the relationship between the desired radius of the blade circular cutting edge and the angle of the curved surface longitudinal axis with respect to the blank faces; and d. feeding the grinding wheel through the blank at the predetermined angle to remove material from the blank to generate the predetermined curved surface connecting the two faces.

2. The method of claim 1 wherein the step of dressing the periphery of the grinding wheel includes the step of dressing the periphery according to the formula:

$$\frac{x^2}{r^2} + \frac{y^2}{(r \sin A)^2} = 1,$$

where x is the coordinate from the center line of the elliptical cross-section in a direction parallel to the grinding wheel axis of rotation, y is the coordinate from the center line of the elliptical cross-section in a direction perpendicular to the grinding wheel axis of rotation, r is the desired cutting edge radius, and A is the angle of the blade blank relative to the direction of travel of the grinding wheel.

3. A method of manufacturing a blade for cutting and stripping insulation from an insulated electrical conductor comprising the steps of:

a. providing a blank generally shaped as a rectangular parallelopiped having two faces and exterior surfaces, b. providing a grinding wheel having a periphery with a predetermined elliptical cross-section corresponding to a desired radius of the blade circular cutting edge and a predetermined angle of a predetermined curved surface connecting the faces, the periphery of said grinding wheel being according to the formula:

$$\frac{x^2}{r^2} + \frac{y^2}{(r \sin A)^2} = 1,$$

where x is the coordinate from the center line of the elliptical cross-section in a direction parallel to the grinding wheel axis of rotation, y is the coordinate from the center line of the elliptical cross-section in a direction perpendicular to the grinding wheel axis of rotation, r is the desired cutting edge radius, and A is the angle of the blade blank relative to the direction of travel of the grinding wheel;

c. feeding the grinding wheel through the blank at the predetermined angle to remove material from the blank to generate the predetermined curved surface connecting the two faces, the curved surface having a longitudinal axis at the predetermined angle to the faces and elliptical contour symmetrical about the axis when viewed along the axis, so that a circular cutting edge is created in the blank at the junction of the curved surface and one of the faces when viewed perpendicular to the blade faces.

* * * * *